United States Patent [19]

Sasaoka et al.

[11] 4,317,661

[45] Mar. 2, 1982

[54] ELECTRONIC AIR CLEANER

[75] Inventors: Ryosuke Sasaoka; Yasuo Ishino; Kaoru Maekawa, all of Yokaichi, Japan

[73] Assignee: Matsushita Electric Industrial Co., Ltd., Kadoma, Japan

[21] Appl. No.: 67,916

[22] Filed: Aug. 17, 1979

Related U.S. Application Data

[63] Continuation of Ser. No. 885,075, Mar. 9, 1978, abandoned.

[30] Foreign Application Priority Data

| | | | |
|---|---|---|---|
| Mar. 16, 1977 | [JP] | Japan | 52-29444 |
| Apr. 15, 1977 | [JP] | Japan | 52-43928 |
| May 9, 1977 | [JP] | Japan | 52-53419 |
| Jun. 28, 1977 | [JP] | Japan | 52-77674 |
| Jul. 12, 1977 | [JP] | Japan | 52-83857 |

[51] Int. Cl.[3] ..... B03C 3/12; B03C 3/41

[52] U.S. Cl. ..... 55/131; 55/132; 55/138; 55/150; 55/155; 55/340; 361/231

[58] Field of Search ..... 55/124, 131, 132, 155, 55/136–138, 150, 154, 339, 340; 361/229, 231

[56] References Cited

U.S. PATENT DOCUMENTS

| | | | |
|---|---|---|---|
| 2,593,377 | 4/1952 | Wintermute | 55/131 X |
| 2,867,285 | 1/1959 | Wintermute | 55/124 X |
| 3,184,901 | 5/1965 | Main | 55/138 X |
| 3,237,382 | 3/1966 | Berly | 55/154 X |
| 3,541,329 | 11/1970 | Roth | 361/229 X |
| 3,573,547 | 4/1971 | Fredrickson | 361/231 |
| 3,582,711 | 6/1971 | Jahnke | 361/231 |
| 3,747,299 | 7/1973 | Chiang | 55/138 X |
| 3,768,258 | 10/1973 | Smith et al. | 55/138 X |
| 3,818,269 | 6/1974 | Stark | 361/231 |
| 3,853,750 | 12/1974 | Volsy | 55/138 X |
| 3,891,415 | 6/1975 | Watanabe | 55/137 X |

FOREIGN PATENT DOCUMENTS

| | | | |
|---|---|---|---|
| 626189 | 7/1949 | United Kingdom | 55/132 |

*Primary Examiner*—Kathleen J. Prunner

*Attorney, Agent, or Firm*—Cushman, Darby & Cushman

[57] ABSTRACT

An electronic air cleaner is disclosed in which the corona discharge wire and the counterelectrode are positioned outside the flowpath of dust-laden air. Diverging electric force lines are discharged from the discharge wire electrode, which is nearer the flow path than the counterelectrode, when a high voltage is applied and ions are directed into the passing airflow path in a reacting area or zone. Dust contained in the air flow path is electrically charged by the ions and collected on a filter, which may also be electrically charged, positioned downstream from the reacting zone. In the device the discharge wire is not directly exposed to the dust-laden air, the electrically charged particles being collected on a separate, easily cleaned filter. The design of the electronic air cleaner requires less maintenance, easier cleaning and a longer period of operational quality.

10 Claims, 10 Drawing Figures

ELECTRONIC AIR CLEANER

CROSS REFERENCE TO RELATED APPLICATIONS

This is a continuation of our earlier application Ser. No. 885,075 filed Mar. 9, 1978, now abandoned.

BACKGROUND OF THE INVENTION

1. Field of the Invention

The invention relates to an electronic air cleaner which discharges the dust, absorbs it electrically and cleans the air.

2. Prior Art

Generally speaking, it is quite difficult to mechanically absorb (e.g. by a filter) fumes of a cigarette, oily mist produced in cooking, or the like since the sizes of the dust or mist are quite small.

To fulfill this objective electronic air cleaners have been conveniently used.

FIG. 1 shows a structure of an electrode part of a conventional (prior art) electronic air cleaner. It comprises dust collector electrodes 100 arranged parallel to the air flow, ion accelerating electrodes 101 having a high opposite potential to the dust collector electrodes 100. Arranged between the dust collector electrodes 100 are discharging wires 102 having the same potential as the ion accelerating electrodes 101, and installed in front of the ion accelerating electrodes 101. Dust collecting is generally carried out in a manner such that the dust in the dirty air, flowing from an intake 103 by a fan 51, is charged by the discharging wires 102, and the charged dust is attracted to and caught on the dust collector electrodes 100 while passing between the dust collector electrodes 100 and ion accelerating electrodes 101. The discharging wires 102 are always exposed to the dirty air and the dust adhering to the discharging wires 102 tends to decrease the operational quality of such a conventional device. If the dirty air includes fumes of a cigarette, oil mist from lard or salad oil, small particles of them are caught by, stick and accumulate on the discharging wires 102.

This decreases the discharging activity of the wire and its charging of the passing dust, thereby leading to a decrease in the dust collecting efficiency. In order to prevent this problem in the conventional air cleaner periodic cleanings of the discharging wires are required to remove the dust thereon. Such cleaning is difficult for household users to carry out, since the discharging wire is likely to be broken or lose its tension.

SUMMARY OF THE INVENTION

The present invention is directed to providing an improved electronic air cleaner. The invention is also directed to providing a superior structure, which prevents the dust from adhering to the discharging wire and improves the maintenance requirements for the apparatus.

The invention further provides means for maintaining the initial charging efficiency for a long time.

DETAILED DESCRIPTION OF THE DRAWINGS

The present invention provides an improved electronic air cleaner which overcomes the problems in the conventional air cleaners of the prior art, as described above.

An ion generating electrode according to the present invention has no direct contact with the dirty air including the dust contained in such air. An ion shower is produced outside the air flow which contains the dust and this ion shower is thrown to the air flow which contains the dust, thereby charging the dust particles in order to be completely caught by a filter. As used herein the expression dirty air means air or gas containing dust, and the word dust is used herein in its broadest aspect to also include the mists of water, several kinds of oil and fat or minute particles of fumes.

The gas to be treated may be a single gas, a mixture of two or more gases as well as atmospheric air. Therefore, as used herein the word air includes several kinds of gases.

Several embodiments are now explained in detail and illustrated in the accompanying drawings.

Figure 1:
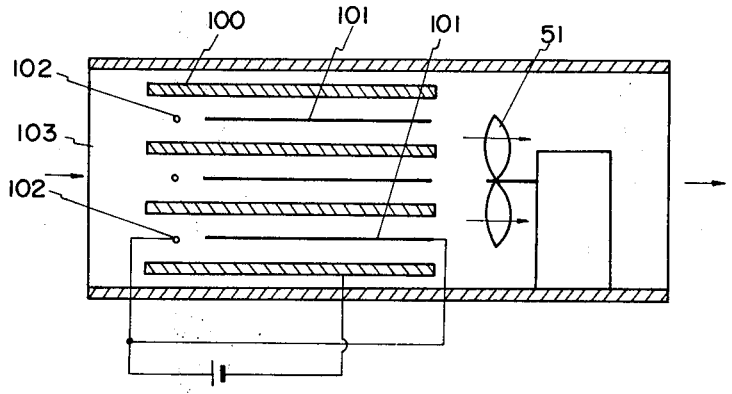
FIG. 1 PRIOR ART
FIG. 1 is an illustrative sectional view of a conventional electronic air cleaner.
Figure 2:
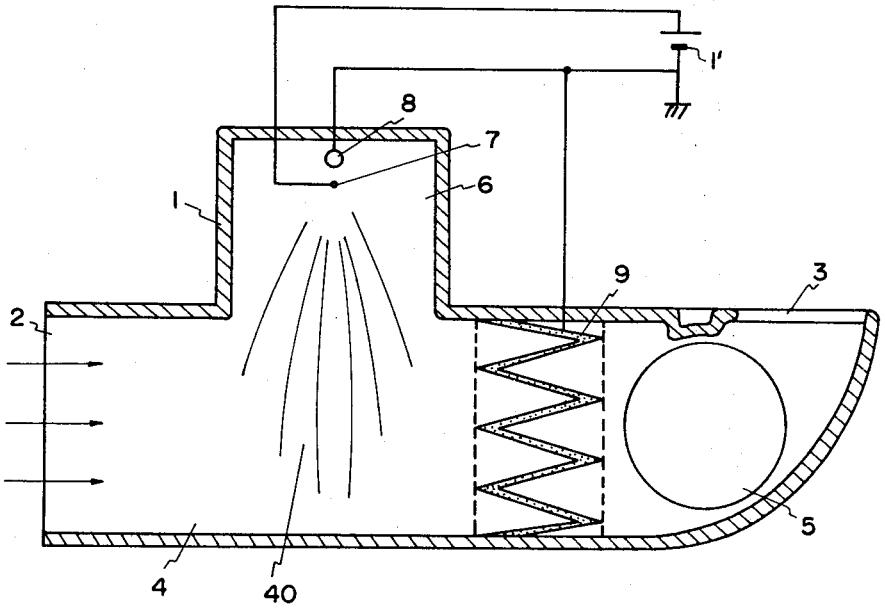
FIG. 2 is a schematic sectional view of an electronic air cleaner according to one embodiment of the present invention.

FIG. 2 shows a first example. The dirty air is sucked in at an intake 2 of a case 1 of an electronic air cleaner. The purified air is exhausted from an outlet 3 of the case 1. An air flow path 4 is formed between the intake 2 and outlet 3, and the air is transported through the air flow path 4 by a fan 5. An ion shower source 6 is formed in a space outside but connecting to the air flow path 4. In this embodiment, the shower source 6 comprises electrodes positioned in a chamber which opens into a reacting space 50 in the air flow path 4. Discharging electrodes comprise at least one ion generating electrode 7 of thin metal wire and at least one counterelectrode 8 of a metal rod, both arranged in a direction transverse to the air flow in the ion shower source 6.

Namely, the electrodes 7 and 8 are disposed in the direction perpendicular to the plane of the sheet of the drawing. The ion generating electrode 7 consists of a fine metal wire. A high tension potential, for example, in this drawing a positive high tension potential from a high voltage source 1', is applied thereto. A counterelectrode 8 having a larger size than and separated a specified distance from the ion generating electrode 7 is installed in a direction transverse of the air flow flowing in and through the reacting space 40, and the counterelectrode 8 is arranged at a distance further from the reacting space 40 than the discharging wire 7.

In the example, the counter electrode 8 is grounded.

The reason why both electrodes 7 and 8 are arranged in a direction transverse of the air flow as abovementioned is to make the resulting ion shower wide and make it cover the whole width of the air flow.

A dielectric filter 9 is installed at a position downstream of the reacting space 40 in the air flow path 4, where the discharging effect by the ion shower is small.

The dielectric filter 9 is made of a non-woven cloth of, for example, polyester and is grounded through a metal net secured to the backside of the filter. The dielectric filter 9 constitutes the dust collector part. Since the filter is grounded in the same manner as the counterelectrode 8, the dust positively charged by the high potential cation shower in the dirty air is caught by the dielectric filter 9.

The purified air is exhausted from the outlet 3 by means of the fan 5.

The ion production and charging state of the dust in the ion shower source 6 can be explained as follows.

Figure 3:
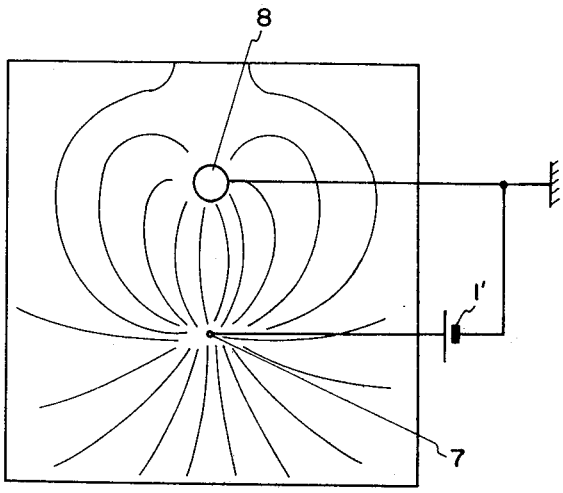
FIG. 3 is an illustration showing the distribution of electric force lines between an ion generating electrode 7 and a counterelectrode 8.

If a voltage high enough to excite a corona discharge is applied between the ion generating electrode 7 and the counterelectrode 8, electric force lines caused by the electrodes 7 and 8 are created as shown in FIG. 3. They diverge from the ion generating electrode 7 in the opposite direction to the counterelectrode 8. Ions, cations in this case, produced by the corona discharge near the ion generating electrode 7 are driven in the directions along with the indicated electric force lines, and accordingly, ions flow into the reacting space 40 like a shower. And so, the dust particles in the dirty air flowing in the reacting space 40 are charged by the resulting ion shower causing the dust particles to have positive charges. An attracting electrode of the same polarity as the electrode 8, for instance the air passing electrode of FIG. 7, the sheet electrode 310 and/or the grounded dielectric filter both as shown in FIG. 8, is disposed within the reacting space to draw ions in the reacting area according to preferred embodiments of the present invention.

As a modified example, the counterelectrode 8 can be produced by a press forming of a sheet metal forming one or parallel pair of protuberance stripes therewith.

In the conventional electronic air cleaner devices, the dust containing dirty air passes through an electric field formed between the discharging wire and counterelectrode, and therefore the dust is charged by the ions flowing between the electrodes exposed in the air flow path. On the contrary, the embodiment of the invention as described above is characterized in that use is made of an electric field with divergent electric force lines emanating from the ion generating electrode 7 in the opposite direction in respect to the counterelectrode 8 so that the dust is charged by the ion shower flowing across the air flow path. In the present invention, it is not necessary to let the air flow between the ion generating electrode and the counterelectrode, and so, their relative spacing and configuration can be freely chosen. The distance is determined such that the electric field force, i.e. the discharging efficiency, satisfies the design condition.

In this embodiment, the electrodes are not exposed directly to the dirty air, and accordingly the problem of the adhesion of the dust thereon is extremely reduced.

Figure 4:
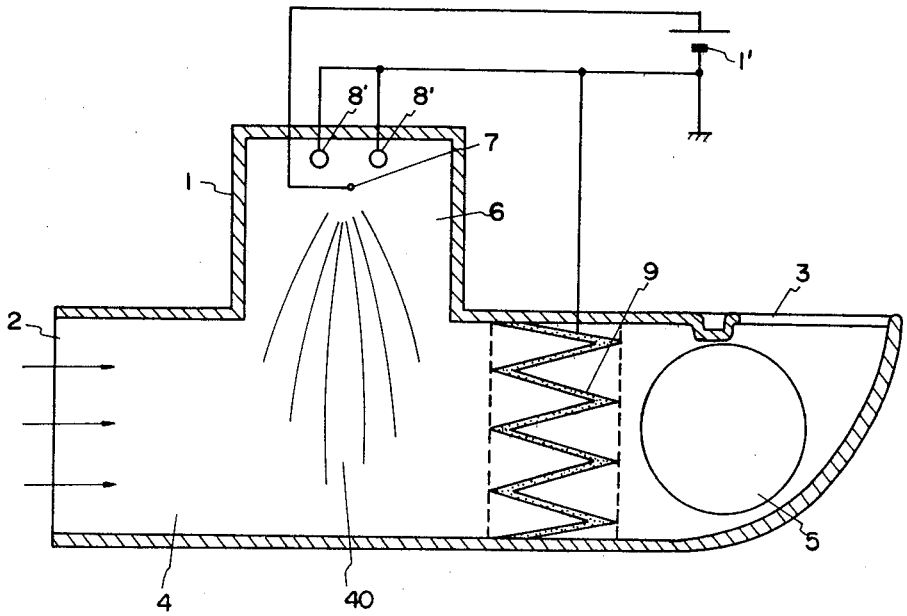
FIG. 4, FIG. 5, FIG. 6, FIG. 7, FIG. 8, FIG. 9 and FIG. 10 are explanatory sectional views showing structures of other electronic air cleaner embodiments of the present invention.

FIG. 4 shows another embodiment of the invention. Several parts are similar to the embodiment shown by FIG. 2, and therefore, for the similar parts, the foregoing elucidations therefore apply. In FIG. 4, two counterelectrodes 8', 8' are installed instead of one in order to stabilize the discharge from an ion generating electrode 7.

FIGS. 5, 6, 7 and 8 show further examples.

The charging conditions of the dust by the ions from the ion shower source 6 and at a dielectric filter 9 are explained in the following:

The ion generating electrode 7 and counterelectrode 8 are positioned apart from each other with a specified space inbetween and the electric field having the electric force lines is formed as shown by FIG. 3. The divergent electric field is formed from the ion generating electrode 7 in the direction opposite of the counterelectrode 8, and at the same time, ions produced near the ion generating electrode 7 are driven along the electric force lines and ions flow like a shower in the air flow path 4. The dust particles in the dirty air flowing in the air flow path 4 are charged by the ion shower. As this ion shower is continuously generated and sprayed out into the reacting space or zone 40, positively charged particles gradually adhere to the surface of a dielectric filter 9, which gradually have excessive positive charges and finally have a relatively high potential. Then, as a result of the high positive potential, positive ions coming continuously from the ion shower source 6 and particles charged by ions are no longer caught by the filter 9 in spite of the air flow produced by the fan 5. Thus, the positive ions and dust particles are gradually stored in the space between the ion shower source 6 and dielectric filter 9, and some of them adhere on the walls of the air flow path. When a large amount of the charge is stored thereby producing a high potential, the space shows the space charge phenomenom. And the diverging electric force lines from the ion generating electrode 7 are distorted. In an extreme case, the space charge eliminates the diverging electric force lines. This fact decreases the charging efficiency for the dust, and the quantity of ions from the ion generating electrode 7 decreases and the discharging current decreases.

In order to increase the discharge current, the following operating methods may be considered:

I. Increase of the applied potential to the ion generating electrode 7.

II. Decrease of the diameter of the wire for the ion generating electrode 7.

III. Shortening the distance between the ion generating electrode 7 and the counterelectrode 8.

IV. Increase the number of the ion generating electrodes 7 and counterelectrodes 8.

However, there are several disadvantages for the above methods.

In method I, a power source for generating a high potential is expensive. The insulation means becomes complex and large in size leading to high material costs.

For method II, the wire of the ion generating electrode becomes very fine and is likely to be broken leading to unstable discharging and resultant vibration. Furthermore, there is a danger of producing much ozone.

For method III, it is quite difficult to stretch the wire of the ion generating electrode, since the space between two electrodes is limited; and this measure is likely to cause vibration leading to the unstable discharging.

For method IV, the costs rise and the apparatus becomes large in size.

Thus, the abovementioned four methods are not suitable for the countermeasures to the variation of discharge current.

Figure 5:
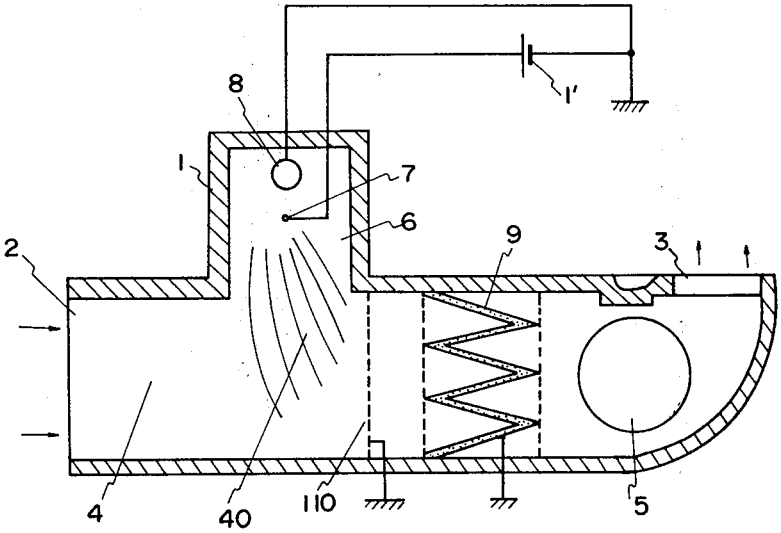

To overcome this problem, as shown in FIG. 5 a grounded and conductive electrode 110 having sufficient air-passing apertures, such as metal mesh, is installed between the ion shower source 6 and dielectric filter 9. By means of the electrode 110, the excessive space charge is readily removed.

This means that suppression of the necessary discharging is released and the discharge is continuously maintained even with a low voltage. The air-passing mesh electrode 110 does not need to be exposed to the entire air flow path, since it need only be large enough in operation to extinguish the excessive part of the ions.

A metal mesh or net having a large mesh is suitable in order not to produce a pressure loss. If the metal mesh is fine, the charged dust particles lose their charges, leading to the decrease of the dust collecting efficiency.

In accordance with this particular embodiment, by means of a rather simple structure, the discharge current can be stabilized by using a lower voltage between the electrodes than the conventional art without substantial decrease of efficiency and substantial increase in flow resistance in the air flow.

Figure 6:
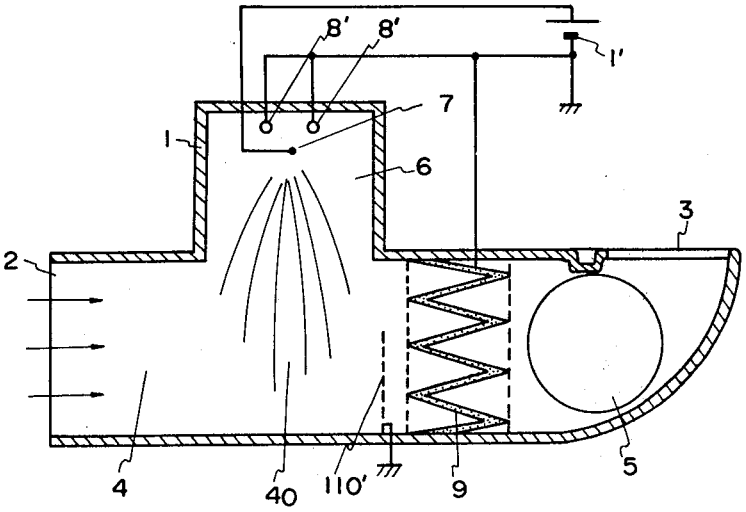

FIG. 6 is another example, where an air-passing electrode 110' such as a coarse metal mesh, is positioned only at the lower part of the air flow path 4. The discharging efficiency is increased, that is because, by means of the effect of the mesh electrode 110', the ions are attracted toward the mesh electrode 110', and thereby the ion density does not decrease so rapidly even at a place distant from the ion generating electrode 7. Thus the ion shower reaches sufficiently to the lower part of the air flow path 4.

Figure 7:
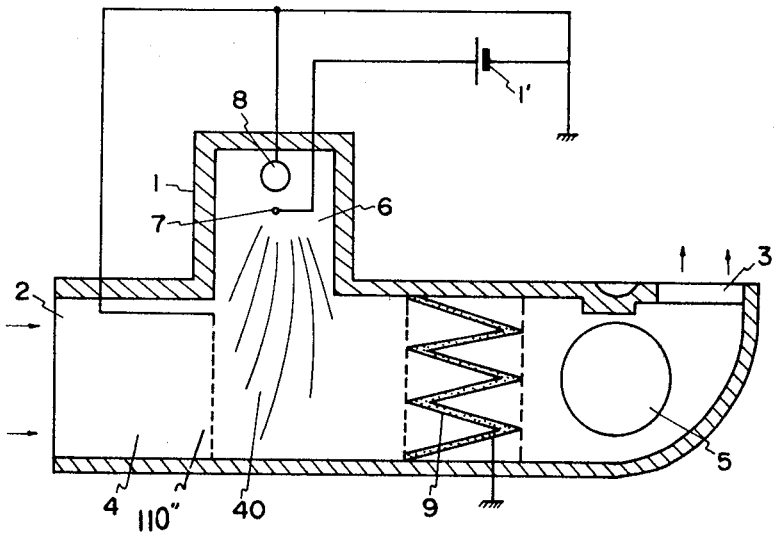
Figure 8:
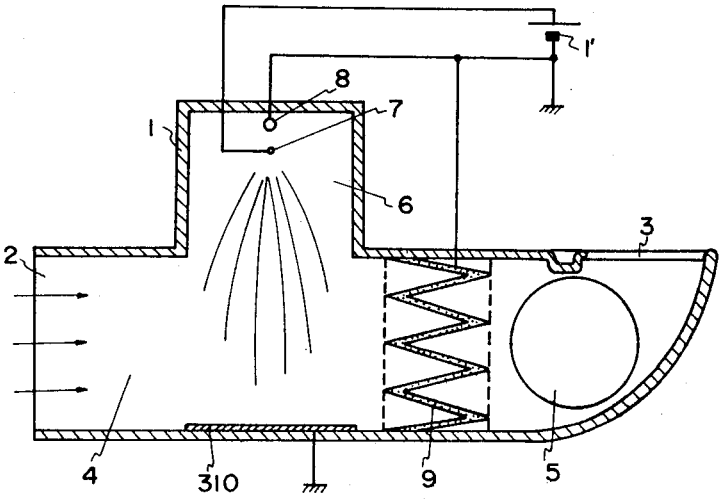

In another embodiment as shown in FIG. 7, an air-passing electrode 110'' is installed at the intake side in an air flow path 4. Using this arrangement, a safety measure is maintained. If a metal bar or similar object should be accidentally inserted into a high voltage portion of an ion shower source 6, the bar is necessarily grounded to shortcircuit the high voltage source. Another advantageous effect is that the diverging electric force lines from the ion shower source 6 are bent toward the upstream-direction of the air flow. Therefore, the time period from the incoming air mixing with the ion shower until the mixed air reaches the filter 9 can be made longer. Accordingly, the discharging efficiency can be improved.

The air-passing electrode need not be installed over the entire surface. It may be only at the lower portion as the mesh electrode 110' of FIG. 6.

FIG. 8 shows another embodiment, where instead of the air-passing electrodes which are used in the several previous embodiments of FIGS. 5, 6 and 7, a sheet electrode 310 such as of a metal sheet positioned at the bottom of an air flow path 4 is employed. In this case there is no disturbance of the air flow in the air flow path 4.

Figure 9:
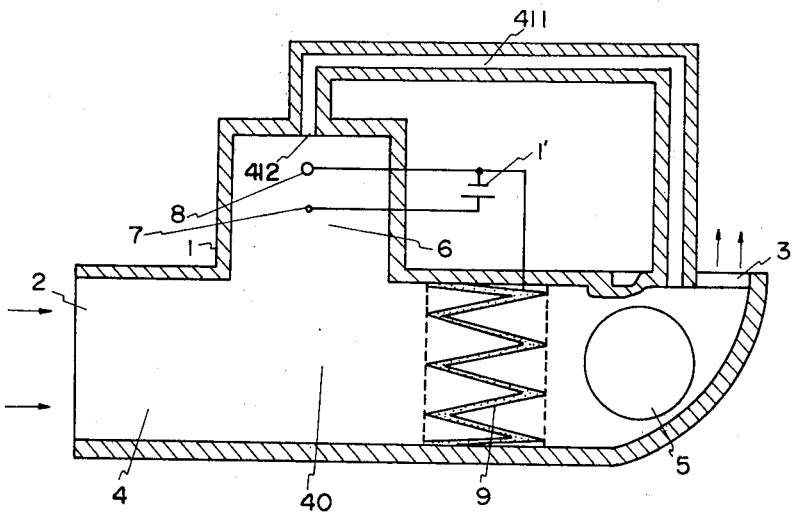
Figure 10:
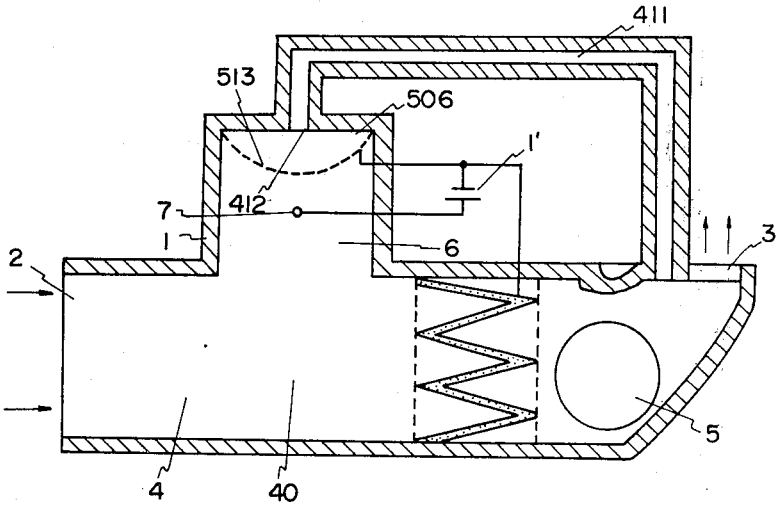

FIGS. 9 and 10 show still other embodiments of the invention.

In FIG. 9 a recirculation duct 411 for the purified air is formed in a manner to communicate with a portion of a recirculated outlet 3 and an air outlet 412 formed on the wall in an ion shower source 6. Part of the purified output air, passed through the dielectric filter 9, is thus directed into the recirculation duct 411, so as to impinge upon the counterelectrode 8 and the ion generating electrode 7. The dirty air is showered by the ions so as to charge the dust by ions coming from the ion shower source 6 and the charged dust is removed by the dielectric filter 9, thereby blowing out the purified air coming from the outlet 3. Part of the purified air passed through the dielectric filter 9 is led to the ion shower source 6 through the flowing path in the recirculation duct 411 and then to the air flow path 4.

Thus, an air flow is produced emanating from the wall of the ion shower source 6 to the air flow path 4.

This flow of the purified air impinges upon the ion generating electrode 7 and counterelectrode 8, and this prevents the dirty air in the air flow path 4 from contacting the electrodes in the ion shower source 6, and hence prevents the dust from adhering to the ion generating electrode 6.

In the embodiment shown by FIG. 10, an air-passing electrode, such as a metal mesh, is used for a counterelectrode 513. In this case the purified air is led through a recirculation duct 411 and blows through the entire area 506 of the counterelectrode 513, and hence, almost all space of the ion shower source 6 is filled with the purified air.

In conclusion, according to the present invention, the ion generating electrode for generating the ions to charge the dust is positioned outside the air flow path. Therefore, the ion generating electrode itself is substantially free from the adhesion of or contamination by the dust contained in the air being cleaned, and the efficiency of the charging and dust collecting does not deteriorate due to the adhesion of cigarette smoke fumes, oil mist or the like. Accordingly, the time required to clean and replace the ion generating electrode can be drastically reduced. The apparatus can be installed in a kitchen, where substantial amounts of oil mist is exhausted. The electronic air cleaners of the present invention have various other applications.

For the abovementioned ion shower, both cation shower and anion shower can be used. Furthermore, alternating showers of anions and cations can be also used, for example by utilizing a D.C. high voltage source of a relatively low alternating frequency.

What we claim is:

1. An electronic gas cleaner comprising:

means defining a gas flow path having an intake for intaking dirty, dust-laden gas, an outlet for discharging electronically cleaned gas and a gas flow path therebetween, a gas transport means for causing said gas to flow from said intake to said outlet of said flow path means, an ion shower source including an ion generating electrode and a grounded counterelectrode both connected to a high voltage source for generating an ion shower and directing same to a reacting area within said flow path means for reaction with said dust, a filter installed adjacent to but downstream of said reacting area in said flow path means so as to remove said dust from said gas such that clean gas is discharged from said outlet, said filter being grounded with respect to said ion shower source, said ion generating electrode including at least one fine metal wire, said ion shower source being installed in a chamber disposed outside of and opening into said reacting area, said ion generating electrode being disposed closer to said reacting area than said counterelectrode, and said high voltage source being sufficient to generate a corona discharge between said ion generating and counter electrodes and said filter to generate an electric field having electric force lines therein which diverge from said ion generating electrode into said reacting area to drive generated ions along said electric force lines, thereby electrically charging said dust contained in said gas by reaction between said ion shower and said dust.

2. An electronic gas cleaner according to claim 1 wherein two counterelectrodes are installed substantially in a direction perpendicular to said flow path within said reacting area.

3. An electronic gas cleaner according to claim 1 further characterized in that an additional counter electrode is installed on a portion of said flow path means which is opposed to and farthest from said ion shower source.

4. An electronic gas cleaner according to claim 1 further including a recirculation duct communicating with said outlet and said ion shower source which recirculates a portion of the thus cleaned gas to a position adjacent said ion shower source.

5. An electronic gas cleaner according to claim 4 wherein said counterelectrode is an air-passing, electrically-conducting net.

6. An electronic air cleaner for charging and removing dust particles contained in a stream of air, said air cleaner comprising:

a housing having a passage therethrough for said stream of air;

ion generating means mounted in said housing adjacent to said passage and outside said air stream including an ion generating electrode and a grounded counterelectrode mounted adjacent to each other for generating an electric field with said ion generating electrode closer to said passage than said counterelectrode, said electric field having diverging lines of force extending across said passage to charge said dust particles in said air;

a further grounded electrode means disposed at the periphery of said passage opposite said ion generating electrode for removing excess space charge;

high voltage means for impressing a potential sufficient to generate a corona discharge, said voltage means being connected to said ion generating electrode, to said counterelectrode and to said further electrode means for generating said electric field; and filter means downstream from said ion generating means and said electrode means for removing said charged dust particles from said air stream.

7. The electronic air cleaner of claim 6 further including means for causing air to flow through said passage.

8. The electronic air cleaner of claim 6 or 7 wherein said ion generating electrode is a thin metal wire.

9. The electronic air cleaner of claim 6 or 7 wherein said further electrode means is disposed in said passage opposite said ion generating means.

10. An electronic air cleaner for charging and removing dust particles contained in a stream of air comprising:

a housing having a passage therethrough for said stream of air;

ion generating means mounted in said housing adjacent to said passage and outside said air stream including a thin wire ion generating electrode and a grounded counterelectrode mounted adjacent to each other for generating an electric field with said ion generating electrode closer to said passage than said counterelectrode, said electric field having diverging lines of force extending across said passage to charge said dust particles in said air;

a further grounded electrode means disposed in said passage opposite said ion generating electrode for removing excess space charge;

filter means downstream from said ion generating means and said electrode means for removing said charged dust particles from said air stream, said filter means being grounded with respect to said ion generating electrode;

means for impressing a high voltage potential sufficient to generate a corona discharge, said impressing means connected to said ion generating electrode, said counterelectrode and said further electrode means for generating said electric field; and means for causing air flow through said passage.

* * * * *